US010240246B2

(12) United States Patent
Kuswa

(10) Patent No.: US 10,240,246 B2
(45) Date of Patent: Mar. 26, 2019

(54) ENHANCED EFFICIENCY ELECTRO-ENHANCEMENT PROCESS FOR SURFACES

(71) Applicant: Fisher Barton Technology Center, Watertown, WI (US)

(72) Inventor: Glenn Kuswa, Madison, WI (US)

(73) Assignee: Fisher Barton Technology Center, Watertown, WI (US)

( * ) Notice: Subject to any disclaimer, the term of this patent is extended or adjusted under 35 U.S.C. 154(b) by 209 days.

(21) Appl. No.: 15/279,059

(22) Filed: Sep. 28, 2016

(65) Prior Publication Data

US 2017/0088966 A1 Mar. 30, 2017

Related U.S. Application Data

(60) Provisional application No. 62/234,251, filed on Sep. 29, 2015.

(51) Int. Cl.

| | |
|---|---|
| ***C25D 11/00*** | (2006.01) |
| ***C25D 9/08*** | (2006.01) |
| ***C25D 9/10*** | (2006.01) |
| ***C25D 9/12*** | (2006.01) |
| ***C25D 21/12*** | (2006.01) |
| ***C25D 11/02*** | (2006.01) |

(52) U.S. Cl.
CPC ..... *C25D 11/028* (2013.01); *C25D 9/08* (2013.01); *C25D 9/10* (2013.01); *C25D 9/12* (2013.01); *C25D 11/00* (2013.01); *C25D 11/024* (2013.01); *C25D 21/12* (2013.01)

(58) Field of Classification Search
CPC .. C25D 11/028; C25D 3/66; C25D 9/08–9/12
USPC ..... 205/231
See application file for complete search history.

(56) References Cited

U.S. PATENT DOCUMENTS

| | | | | |
|---|---|---|---|---|
| 4,009,086 A * | 2/1977 | Komatsu | C25D 9/10 205/230 |
| 9,765,441 B2 * | 9/2017 | Sista | E21B 17/1085 |
| 2011/0287270 A1 * | 11/2011 | Tsurumi | C25D 9/04 428/457 |

* cited by examiner

*Primary Examiner* — Brian W Cohen
(74) *Attorney, Agent, or Firm* — Quarles & Brady LLP

(57) ABSTRACT

This disclosure provides systems and methods for improved electro-enhancement of surfaces of workpieces. The systems and methods can include immersing a metal workpiece in a salt bath and applying a time-varying electric current that has periods of high current with periods of lower current between. The systems and methods provide borided metal workpieces that contain preferred borides on the surface and lack less preferred borides. For example, the systems and methods can provide borided steel having $Fe_2B$ and substantially lacking FeB on the surface.

20 Claims, No Drawings

ENHANCED EFFICIENCY ELECTRO-ENHANCEMENT PROCESS FOR SURFACES

CROSS-REFERENCE TO RELATED APPLICATIONS

This application is related to, claims priority to, and incorporates herein by reference for all purposes U.S. Provisional Patent Application No. 62/234,251, filed Sep. 29, 2015.

BACKGROUND

This disclosure relates generally to improved systems and methods for electro-enhancement of metal surfaces.

Electrochemical methods exist to enhance the surfaces of metal and non-metal materials, in particular ferrous metals, with one or more impregnating species, such as boron. The impregnating species can occupy positions within a crystal structure of the metal or non-metal material or can form compounds with the metal or non-metal material. Thermochemical processes utilize mixtures of compounds and reactants that, when heated, release impregnating material vapors that interact with metal or non-metal materials at high temperatures. The mixture can be packed around parts or locally applied as a paste. One example of such a process is pack boriding. Processes like these are widely applied due to the simplicity and low capital investment, but downsides include the labor-intensive nature of the process and a significant waste stream, and the generation of boron and its reaction with and diffusion into the substrate are not independently controllable, limiting the range of outcomes.

Other methods exist, including gas-based or plasma-based methods where impregnating materials can be introduced into heated chambers, high-energy ion beam implantation, or intense plasma treatment, but each of these processes has shortcomings.

In the context of boronizing of ferrous metals, and in particular steel, two types of boron compounds are commonly formed on the surface of the ferrous metals. At the beginning of the process, $Fe_2B$ is the dominant species. $Fe_2B$ is a hard compound that provides excellent wear properties for use in tool applications. $Fe_2B$ has thermal expansion characteristics similar to steel, and its icicle-like protrusions into a steel substrate that strengthen the binding between the $Fe_2B$ and the steel substrate. $Fe_2B$ can withstand mild flexure and thermal shock without flaking off the surface. However, as the $Fe_2B$ forms, the resistance to further flow of boron into the steel increases. A simple analogy is that of a blotter or paper towel edge contacting water, where after an initial inflow, the process slows due to the "back pressure" from the wetted portion.

When a boron concentration near the steel exceeds a certain threshold that is necessary for the inward growth of the $Fe_2B$, FeB forms on the surface. FeB is harder than $Fe_2B$, but much more brittle. Moreover, FeB has thermal expansion properties that are much different from steel, so the FeB tends to chip off (known as spallation) when parts are cooled in post-processing. It is known that FeB can be reduced or eliminated by subsequent heat treatment in the absence of current, boron, and oxygen. However, this means of reducing or eliminating FeB can result in a porous material with less than ideal material properties.

Thus, a need exists for systems and methods for improved electro-enhancement of surfaces that overcome the shortcomings discussed above.

BRIEF SUMMARY OF THE INVENTION

The present invention overcomes the drawbacks discussed above by providing systems and methods for improved electro-enhancement of surfaces.

In one aspect, this disclosure provides a method of boronizing a surface of a metal workpiece using an electrochemical system. The electrochemical system can include a furnace including a salt bath and an electrochemical circuit including a power supply, a pulse generator, a cathodic contact electrically coupled to the metal workpiece, and an anode, the anode positioned in the salt bath. The method can include the following steps: a) immersing at least a portion of the metal workpiece in the salt bath, thereby positioning the metal workpiece at a distance of between 0.1 mm and 10 cm from the anode, the salt bath comprising at least one source of boron, the salt bath having a temperature between 500° C. and 1500° C.; b) subsequent to step a) and using the power supply and the pulse generator, applying a time-varying electric current between the metal workpiece and the anode for an overall duration of between 1 minute and 180 minutes, thereby boronizing the surface of the metal workpiece, the time-varying electric current comprising a primary electric current pulse and a secondary electric current pulse, the primary electric current pulse providing a primary current density that initiates release of boron from the at least one source of boron, the primary electric current pulse having a primary pulse duration of between 1 ms and 15 s, the secondary electric current pulse providing a secondary current density that is less than 50% of the primary current density, the secondary electric current pulse having a secondary pulse duration of between 0.01 s and 250 s; and c) removing the metal workpiece from the salt bath.

In another aspect, this disclosure provides a method of boronizing a surface of a metal workpiece using an electrochemical system. The method can include the following steps: a) immersing at least a portion of the metal workpiece in the salt bath, thereby positioning the metal workpiece at a distance of between 0.1 mm and 10 cm from the anode, the salt bath comprising at least one source of boron, the salt bath having a temperature between 500° C. and 1500° C.; b) subsequent to step a) and using the power supply and the pulse generator, applying a time-varying electric current to the metal workpiece for an overall duration of between 1 minute and 180 minutes, thereby boronizing the surface of the metal workpiece, the time-varying electric current comprising a non-zero baseline current density and a series of primary electric current pulses, the series of primary electric current pulses providing a primary current density that initiates or facilitates release of boron from the at least one boron source, the series of primary electric current pulses each having a primary duration of between 1 ms and 15 s, the series of primary electric current pulses having a pulse repetition of between one pulse every second and one pulse every 250 seconds; and c) removing the metal workpiece from the salt bath.

In yet another aspect, the present disclosure provides a method for boronizing a surface of a steel workpiece using an electrochemical system. The method can include the following steps: a) immersing at least a portion of the steel workpiece in the salt bath, thereby positioning the steel workpiece at a distance of between 0.1 mm and 10 cm from the anode, the salt bath comprising at least one source of boron, the salt bath having a temperature between 500° C. and 1500° C.; b) subsequent to step a) and using the power supply and the pulse generator, applying a time-varying electric current to the steel workpiece for an overall duration of between 1 minute and 180 minutes, thereby boronizing the surface of the steel workpiece, the time-varying electric current comprising a primary electric current pulse and a secondary electric current pulse, the primary electric current pulse providing a primary current density that initiates or facilitates release of boron from the at least one source of boron, the primary electric current pulse having a primary pulse duration of between 1 ms and 15 s, the secondary electric current pulse providing a secondary current density that is greater than a first threshold above which $Fe_2B$ forms on the surface and less than a second threshold above which FeB forms on the surface, the secondary electric current pulse having a secondary pulse duration of between 0.01 s and 250 s; and c) removing the steel workpiece from the salt bath.

The foregoing and other aspects and advantages of the invention will appear from the following description.

DETAILED DESCRIPTION OF THE INVENTION

Before the present invention is described in further detail, it is to be understood that the invention is not limited to the particular embodiments described. It is also to be understood that the terminology used herein is for the purpose of describing particular embodiments only, and is not intended to be limiting. The scope of the present invention will be limited only by the claims. As used herein, the singular forms "a", "an", and "the" include plural embodiments unless the context clearly dictates otherwise.

Specific structures, devices, and methods relating to improved surface treatment are disclosed. It should be apparent to those skilled in the art that many additional modifications beside those already described are possible without departing from the inventive concepts. In interpreting this disclosure, all terms should be interpreted in the broadest possible manner consistent with the context. Variations of the term "comprising" should be interpreted as referring to elements, components, or steps in a non-exclusive manner, so the referenced elements, components, or steps may be combined with other elements, components, or steps that are not expressly referenced. Embodiments referenced as "comprising" certain elements are also contemplated as "consisting essentially of" and "consisting of" those elements. In places where ranges of values are given, this disclosure explicitly contemplates other combinations of the lower and upper limits of those ranges that are not explicitly recited. For example, recitation of a value between 1 and 10 or between 2 and 9 also contemplates a value between 1 and 9 or between 2 and 10. Ranges identified as being "between" two values are inclusive of the end-point values. For example, recitation of a value between 1 and 10 includes the values 1 and 10.

This disclosure provides an electrochemical system for enhancing a surface of a workpiece, which can be utilized to perform the methods described herein. The system can include a furnace including a salt bath, an electrochemical circuit including a cathodic contact for the workpiece and an anode positioned in the salt bath. In some applications, the anode can be the containing vessel. The electrochemical circuit can be connected to a power supply and a pulse generator. The salt bath can include at least one source of boron.

Suitable furnaces include furnaces capable of achieving the conditions described herein, and are known to those having ordinary skill in the art. In many of the furnaces that are described, if oxygen is present, protracted operation of crucibles at required temperatures can result in erosion owing to corrosion at the crucible-fluid-atmosphere interface, as well as at interfaces where electrodes or workpieces penetrate the electrolyte surface. Therefore, for protracted operation, a blanket of nitrogen, argon, or another gas inert to the materials used can be used as part of the design. Additional protective means for crucibles include protective coatings and biasing of the crucible wall cathodically at a small current density to afford cathodic anti-corrosion potentials.

Another aspect of many furnace designs of interest in boronizing is that the salts used can undergo substantial expansion when heated from the solid phase to the liquid phase, amounting to several tens of percent by volume. Therefore, furnaces using vessels containing molten electrolyte can be kept in constant hot operation, or provision can be made to remove salts before cool-down, thus avoiding damage during resumption of operation. Additionally, salt levels can be adjusted to account for the desired operating temperature and a given displacement from treated parts.

Still another aspect of furnace designs can be a capability to allow parts to diffuse in place with boronizing current reduced or absent for the purpose of diffusion-annealing undesirable FeB away and/or converting the excess boron into $Fe_2B$. Accordingly, a furnace can be configured to reduce or stop the current while a part remains immersed in a salt bath.

Yet another aspect of furnace design is that some furnaces, such as those based on induction heating or that pass electric current through the electrolyte to heat the furnace may pass current through the parts in a manner that could interfere with electro-boronizing. According to one aspect of this invention, boronizing can be performed during interruptions in furnace power that are synchronized with the boronizing pulse train.

Yet another aspect of this invention replaces the conventional furnace with an anode configured with a shape conforming to the cathode (the part to be boronized), with said components sized so as to maintain a separation that contains the electroboronizing fluid. Said anode-cathode assembly is heated to a temperature noted for the above-mentioned furnaces. This aspect can include static anode cathode pairs of virtually any shape, or may include parts that are symmetric and movable. An example is an anode taking the shape of a section of a cylindrical shell that is placed against a shaft that is slowly rotated as boronization takes place. It should be appreciated that the electroboronizing fluid can be introduced in its molten state or can be introduced in a non-molten state and then heated until molten.

An advantage of the processes described in this invention is that it is possible to remove the workpiece for transfer and further immediate treatment at desired temperatures, thus completing heat treatment. In contrast, pack and paste methods usually require removal from the boriding materials, and movement while at treating temperatures releases significant quantities of highly toxic gases; thus standard practice with paste and pack methods involves cooling parts, removal of the boriding medium, and then re-heating and quenching to the desired properties. In some furnace configurations, the part can be removed and transferred to another liquid bath, and in other furnaces, such as those contained in vacuum or inert gas chambers, the subsequent heat treatment can be accomplished in place by rapidly introducing quench gas.

Examples of, suitable furnaces include, but are not limited to the examples recited in the paragraphs that follow, as well as similar furnaces as will be appreciated by those having ordinary skill in the art.

1) Furnaces heated by electromagnetic fields emanating from coils surrounding a vessel comprised of materials that absorb the electromagnetic energy and convert it into heat. Crucibles can be composed of metals, graphite, silicon carbide, or other materials that have appropriate electric resistivity to couple energy into the vessel walls, rather that penetrating to a large extent into the contents of the vessel. Such materials as well as the characteristics of the induction heating apparatus (frequency, power, coil geometry, etc.) are known to those who practice the art of inductive furnace design. As one example, a graphite crucible having wall thickness two inches with furnace frequency in the frequency range of 600 Hz to 3000 Hz. The feed lines to the anode and cathode can be mounted radially, and if necessary, the leads can be adjusted in position to minimize electromagnetic coupling from the induction currents through the power supply. The alignment configuration is not necessarily critical for all configurations described herein, and can be easily be attained by those trained in electro-magnetic technology. Among materials suitable for crucibles are graphite, silicon carbide, steel, Inconel, and other materials having similar properties. Manufactures of such furnaces include Pillar, Inductotherm, and many others.

2) Resistively heated furnaces may be used, which employ heating elements disposed around the outside of the vessel, or heat can emanate from resistive elements encased in high temperature sheathes that resist attack from boriding chemicals, such self-contained units being immersed within the salts in the vessel. In one aspect detailed below, current supplied by wires attached directly to the vessel can provide heating. Many commercial manufacturers provide resistive heating equipment.

3) A suitable furnace may also comprise a bath that is heated by passing electric current through a molten electrolyte, thereby depositing thermal energy directly within the electrolyte; the electrolyte can be the same mixture being used to effect boronization, or a second vessel can be suspended within said molten electrolyte, and be used to contain a second electrolyte that is used to conduct electroboronization. The advantage of employing a second vessel is that purity of the boriding salts is better maintained by avoiding the contamination that arises from heating electrode erosion in some furnace designs. Various features or user protocols can prevent cross-contamination between the vessels. Avoiding or reducing impurities can be important when using direct resistive heating by current flow through electrodes; impurities can be reduced by using tin oxide, graphite, or other electrode materials that do not readily erode, or whose chemical makeup will not adversely influence boriding performance. A manufacturer of furnaces that provide heat by means of passage of electric current through an electrolyte is the Ajax Company.

4) Electroboronizing vessels may also be heated under vacuum conditions or surrounded with inert gases in furnaces that are heated by means of radiant emitters or heaters that may be in direct contact with workpieces, or by inductive coupling of energy directly to workpieces, or by inductive coupling to vessels in accord with the above description for non-vacuum furnace configurations. Radiant vacuum furnaces are manufactured by Ipsen and Solar, as well as other companies. In the case that workpieces are directly heated by induction methods or have their heating augmented by direct induction, it can be advantageous to briefly interrupt the induction heating during the primary boronization pulse so that the induction fields do not disturb the boronization process.

5) Practitioners using high temperature furnaces capable of maintaining temperatures in boriding electrolytes (generally in the range of 1500-2200° F., but temperatures as low as 600° F. can be used with long boronization times) will recognize that other means of heating can be employed, including, but not limited to, high temperature flame heating, microwave heating, electron beam heating, and heating with lasers or other sources of concentrated radiant energy, and the furnace descriptions provided above merely give examples of some common methods of heating. Various types of furnace will find application for specific applications of boronizing—for example parts that may be comprised of materials that require special thermo-cycling or that must be protected from atmospheric corrosion.

Parts with certain geometries may be heated locally by various means, including those mentioned above, and the methods for surface treating described herein may be applied locally to a portion or to the entirety of a part. The term immersion as used herein may therefore include parts that are only partially contacted with boronizing fluids. For example, a heating means may comprise elements that can dispense and retain a layer of fluid between said element and the object being treated or a portion thereof, such as a semi-circular convex element with a curvature slightly smaller than the inside of a pipe or bearing sleeve being treated. Similarly, a ring-shaped or concave segment fixture can maintain a layer of boronizing fluid between itself and a shaft being treated, relying on the wetting nature of the salts to retain the fluid. Depending upon which element is to become boronized-shaft or ring, either element could be anode or cathode with respect to the other electrode. Yet another example would be a part configured to retain boronizing fluids in a recessed area, with an anode positioned to contact the fluid and shaped to provide a desired current density pattern and boronization properties in the work piece. The geometry of work piece and anode could be switched along with reversing polarity. An example can be cited as an anode comprising a V-shaped or rectangular recess in a suitable anode material, for example a heated graphite block , with said recess containing boronizing fluid; the workpiece may be a blade with a knife edge, or a bar, whose edge and the area close to its edge would be boronized. While many heating methods cited above would work, this configuration could be heated by passing electric current directly through an electric heating element in thermal contact, but electrically isolated from the said graphite block. A combined single refractory heater and anode can be used; for simple geometry parts, a person having ordinary skill in the art of heater design, can apply heating current that will not interfere with the boronizing electric potentials. Other materials could readily be substituted for graphite.

To extend the above-described shallow configuration for boriding part of a simple workpiece geometry to more complex shapes, a groove or channel of varying depth, shape, and cross section to contain molten boriding fluid may be provided to accommodate portions or all of the workpiece surface, thus economizing on the quantity of boronizing compounds required in comparison with an ordinary crucible to hold fluid. An additional aspect of this configuration is that, unlike the boronizing baths conventionally described, the fixture containing the groove or recess for boronizing fluid can be readily heated to spatially varying temperatures, and tailored boronization depths can thereby be achieved, as the reaction rates and diffusion of boron with the workpiece are responsive to temperature change. Since the shaped groove serves as the anode surface in this configuration, the anode-cathode separation can also be varied to adjust local current density to provide a second means of varying boronization. Thus, by being able to adjust spatially variable current density and temperature over the boronized surface of the workpiece a graded degree of boronization can be achieved, the inventory of boronizing fluid can be minimized, and the workpiece can be boronized in selected areas. The work piece can be held suspended in said fluid-filled groove, and in this aspect of the invention, electric contact to the workpiece can be a clamped connection above the fluid level. In this manner the edge only may be boronized, causing its surface to be hardened, without expending boronizing capacity on portions of the blade not subjected to extreme wear, and better-preserving other desired surface properties on most of the blade area. Since only relatively small portions would be subjected to boronization using this geometry, more modest electric connections can be used, and clamping is simplified because clamps can be used at temperatures that will not weaken clamp material, as the work piece may be maintained at elevated boronizing temperature on its treated edge, and can be cooler on its clamped face. This method can have the advantage of treating in a well-secured configuration that resists warping.

On certain workpieces, such as the thin edge of blade it may be desirable to limit the amount of boronization to thin layers on edges to avoid excessive brittleness. Sharp edges immersed in electrolytic processes tend to enhance the strength of local electric fields, increasing deposition in a region where such enhancement is not desired, because the blade edge may become prone to chipping. In certain instances, it is required to prevent boronization of a portion of a workpiece, for example on a portion that is later to be welded to another part. The following approaches can be used to control the spatial distribution of boronization: 1) Blades may be geometrically arranged in the treatment bath so that the sharp edges face away from anode surfaces. 2) An auxiliary electric conducting structure, herein designated as a shield can be placed in close proximity to the edge to be protected, and held at a potential that partially shields the sharp edge, thereby reducing its boronization; in a particularly simple aspect of this method, the shield may be held at the workpiece potential, and may be the face of another workpiece. All workpieces may thus be arranged in a manner that assures that localized areas of each part receive desired different treatment results. If the shield structure is in actual close contact with the workpiece, boronization in that region of the workpiece will be zero, and if the separation is increased, some boronization will take place.

Aluminum oxide shields or other dielectric materials resistant to boronizing fluids can also be placed around or over workpieces immersed in boronizing fluids and will prevent the boronization process. However, in the three-phase edge region where the aluminum oxide insulator meets the workpiece and the boronizing fluid there is an enhancement of local electric field, and therefore there is a small region at this junction where enhanced activity can occur. This effect can be used to manage the boronization process in small regions for specialized applications. For example, if it is desired to produce some localized regions with superior hardness and wear in localized places on a part, a non-conducting mask, such as boron nitride or aluminum oxide may be used with holes provided in the desired positions for boron deposition, and boronization will take place in those locations, saving power and chemicals that would be required if a conducting mask were to be used. A similar conducting mask would have its surface boronized, and its holes would partially shield the boronization. The mask in one aspect can be a separate structure placed in contact with the workpiece, and in another aspect can be positioned at a distance from the workpiece to achieve a graded boronization result, In yet another aspect, the mask can be applied to the workpiece and configured in situ by conventional mask etching methods known in the semiconductor and fabrication industry. The dielectric shield method permits much improved precision, especially for small features, and presents an opportunity to make objects by a process we will call boron electro-lithography.

It is not possible to specify the exact geometry and separations for all possible configurations, as the composition of the boronization fluid, the pulse duration, the temperature, and other factors influence the outcome. Experiments have shown the absence of boronization on the ends of rectangular low carbon steel bars by encasing the bars in end caps that had clearances of about 0.003 inches and extended 0.300 inches from the ends, said caps being used also as mounting places and cathode connections to physically mount the workpieces and to provide current. Boronization was reduced by approximately 50% on part surfaces comprising sharp knife-like edges partially shielded from the anode by positioning the sharp edges out of line of sight from the anode. The management and control of local boronization is established by these observations.

Power supplies for boronizing should be able to supply direct current to the components being treated, and through the electrolyte and anode to complete the circuit. Since large currents may be required, for example several kilo-amperes for parts having aggregate area of approximately one square meter, there can be substantial voltage drop in the bus bars or cables that connect the components, and in some cases through voltage drops in the workpieces themselves. Accordingly, the power supplies can specify voltages well in excess of the cell voltage used to effect the electrochemical reactions that result in boronizing. Experiments have shown that power supplies that provide a maximum voltage of approximately 15 volts give adequate voltage to overcome resistive voltage drops and drive boriding adequately with power leads sized to operate at a temperature rise of approximately 150° F. Because pulsed treatments were employed using primary and secondary pulses with duty cycles of primary boronizing current typically between 5% and 50%, with a much reduced secondary current—typically 5-20% of the value of the primary current being applied between pulses, the connecting conductors can be sized considerably smaller than would be required for steady current application, and cables and bus bar circuitry can be sized smaller than would otherwise be required.

The primary power supply can also be smaller—for example, by a factor of two—, than would otherwise be the case, because the power supply can be switched to various batches of parts under treatment during the time that would otherwise remain switched off. The heating load on the conductors is proportional to the square of the applied currents times the duty cycle, so under pulsed conditions, the heating can be greater during the more-intense primary pulses, with negligible heating during the secondary current part of the applied waveform. The power supplies may be selected from those available from many manufactures, BK Precision or others, for research applications or treatments up to 60 amperes peak, or from suppliers of commercial electroplating power supplies. The class of supplies known as switched power supplies and known in the electroplating trade as rectifiers, can be applicable for boriding. Suitable power supplies can be capable of programmed delivery of power, for example, in the controlled current mode. Some rectifiers have internal timers and current level settings, and can include a built-in waveform generator to control the output. A single controlled power supply can be used to provide primary and secondary power, or advantageously separate power supplies can be used to provide the intense and holding pulses, so that the more costly primary power supply can rotate between treating multiple loads of parts, but this requires additional switching.

Still another power supply alternative can be constant voltage power supplies with series resistors between power supply and various components in a load. In this configuration, if the resistor is sized to provide a voltage drop substantially greater than the voltage variation between anode and treated parts, the current can be adequately stabilized. The ripple in the power supply current should be less than approximately 20%, a condition easily provided by many power supplies, and advantageously may be reduced to a few percent using simple resistive-capacitive filtering, as understood by electrical engineers. Voltage stabilized and current-stabilized power supplies can be utilized in the systems and methods described herein.

The anode can comprise an anodic material that readily conducts electric current, as high current pulses are used in this process. Poor conductors would deteriorate, and only the area surrounding the entry point into the electrolyte would participate in the boronization process owing to resistive voltage drop. Suitable anodic materials include anodic materials capable of withstanding the temperatures and chemical conditions described herein, while providing sufficient conductivity and not chemically interfering with the methods described herein. Suitable anodic materials are known to those having ordinary skill in the art. For example, suitable anodic materials include graphite, boron, platinum, tin oxide, or other metals such as vanadium may be co-deposited with boron in certain more advanced treatments, a combination of materials designed to release into the boronizing fluid just the appropriate quantity of an element that provides additional desired properties to the boronized surface, and the like. In some aspects, the anode can comprise boron fragments or ferro-boron fragments contained within a basket comprising anodic material.

In certain aspects, metal anode connections submerged in the electrolyte, and/or foreign materials in the anode can be avoided, as being biased as anodes, some metals can deplate into the electrolyte and poison the boronizing process. For example, a small exposure of copper or iron connected to the anode, can disrupt or greatly impede boronization. In some aspects, graphite can carry the entire anodic power flow through the atmosphere-fluid interface, with all current-carrying connections above the fluid surface and no metal exposed to the fluid.

The cathodic contact can comprise a cathodic contact material. Suitable cathodic contact materials include materials capable of withstanding the temperature and chemical conditions described herein, while providing sufficient conductivity and not chemically interfering with the methods described herein. Suitable cathodic contact materials are known to those having ordinary skill in the art, and may comprise elements or alloys that can form borides, many of which exhibit extreme hardness and refractory properties; other candidate materials may accept boron atoms into their crystal lattice structure, not forming stoichiometric chemical compounds, but providing modified electronic, optical, or mechanical properties. This latter process is often called doping. For example, suitable cathodic contact materials include low or medium carbon steels, stainless steel, titanium, or other conductors that retain strength at the temperatures of the boronization bath. Steels or other alloys that can contain nitrogen are also capable of boriding and can include the formation of boron nitride among various other beneficial hard constituents. Copper and its alloys may be used above the electrolyte bath level, or below the bath if it always biased negatively with current to prevent the migration of copper into the electrolyte.

The workpiece can be electrically coupled to the cathodic contact by way of a cathodic coupler. The coupled connections may be submerged in the molten salt, or may be completed outside the molten region, but if made outside the salt, it can be beneficial to assure that oxide layers or other causes of bad connection do not result in arcs or excessive heat that could disrupt operation. To some extent, providing an inert or otherwise protective gas can reduce such problems, but may not be sufficient, and connections made below the salt surface can be advantageous due to simplicity.

The cathodic coupler can include a conductive wire, a conductive weld, a conductive bolt, a conductive rack with slots or pins to provide alignment of one or a multitude of parts, a moving tumbler structure that is held at cathode potential and comprised of a perforated material that exposes the workpiece to the electric fields from the anode, and/or with an anode inserted within the tumbler, a basket with large mesh that allows the penetration of boronizing electric fields. In all embodiments for racking, a common feature is that the boronizing potential fields between anode and cathode must provide the necessary average boronization current density on the faces of parts that are to be boronized. Therefore, if parts are tumbled or if the parts are moved in physical position relative to anodic members, an average exposure to boronizing action may be less than if the parts were to be arranged in a static configuration; in such cases, longer exposure times, or increased current density can be required to achieve desired results. The materials used for cathode connection and basket construction can include many conducting materials, so long as those materials are able to permit the flow of the specified electric current to the parts, do not melt or deform at the temperatures used, and do not react with the boronizing fluids under cathodic polarization.

It has been discovered that mild steel serves well in the capacity of cathode racking structures for multiple runs, but sufficient thickness should be provided, as explained in the following text. While the surface of mild steel becomes boronized to a considerable depth after multiple treatments, the core retains sufficient strength to maintain integrity. For example, racks constructed from 10B38 low-carbon steel 0.1 inches thick, has survived at least six runs of 1½ hour pulsed boronization that individually produce 0.005 inches borided thickness on virgin parts, and the rack material was suited for many more runs. However, it is advisable for protracted production of many treatment runs to use alloys that boride more slowly and therefore will maintain core strength and dimensions to a greater extent than ordinary carbon steels. Type 304 stainless steel may be suitable for extended use in racking, as it is known to boride much more slowly than low carbon steel such as 10B38. Tantalum or tantalum plated surfaces may be suitable for very extended service life with minimal change in dimensions or strength, but such materials are costly and more difficult to fabricate. The preferred material will depend on the relative costs and the extent of runs, but ordinary steels can be suitable for limited numbers of runs and for confirming the efficacy of rack designs for production runs.

Of special note is the configuration to treat areas such as the interior of pipes, channels, or the like, or the outside of parts. In this particular instance, there is advantage to use an interior or exterior anode member that has two surfaces that vary in proximity to the part undergoing treatment. One anode surface, appropriately proximate (typically from ¼ inch to ½ inches away from the surface to effect current density equal to the primary pulse current density specified, and a second surface that is farther spaced from the part being treated so that the holding secondary current density is maintained. The two-surface anode structure is caused to cyclically move in an axial or rotational (or combined spiral-like) direction during the boronizing operation, depending upon the details of the anodic electrode, thus effecting approximately the same response that would be obtained by the methods described elsewhere in this application as primary and secondary pulses. The intense current density analogous to the primary pulse is thus provided as the residence time over the treated material by the close separation and the residence time of the more distant portion of the anode-cathode pair is analogous to the secondary pulse.

It will be apparent to those persons familiar with electro boronizing and electroplating that mechanical scanned structures containing anode members at different distances from parts may be fabricated to treat the inside and outside of parts such as tubing, shafts, rods, and other shapes of moderate complexity. Designs of such mechanically scanned boriding tools include means for providing uniform homogeneous coatings over a workpiece, as well as localized coatings, and further flexibility of design is afforded by being able to switch off or modulate the boriding process with a combination of electric control and mechanical scanning over a workpiece. An inherent advantage of this dynamic system is that the mechanical motion will aid in fluid mixing and will promote more uniform treatment that would result from many geometrically fixed systems. Note that various combinations of motion relative to anode and cathode can cause the action described to emulate pulsed treatment. For example a part connected as cathode may be caused to alternately approach and retreat from an anode surface, thus changing current density in a manner that creates the same effect as a mechanically fixed system that is treated by modulating the current flow.

In certain aspects, the methods described herein can provide significantly improved electro-enhancement performance, such that the workpiece can be electrically coupled to the cathodic contact by way of a loose conductive wire connection. In certain aspects, the electric coupling can be retained by the force of gravity acting on the workpiece. The conductive wire can have a thickness determined by the current to be carried. The wire should be thick enough that the wire is not be completely boronized through the core during the boronization treatment. For example, 16 gauge iron wires threaded through a ¼ inch hole in a part and a similar hole in the cathode feed, and borided at a current of 30 amperes performed well without failures. The wire and its connections to parts undergoing treatment and its connection at the cathode feed terminal must be submerged in the salt to prevent oxidation on the current-carrying contact areas, and to assure that resistive heat energy in the wire from current delivered through the wire is carried away by the surrounding boronizing fluid. After treatment, the wire can become embrittled from boronization of the surface, and can be conveniently removed by fracturing, for example by attempting to kink the wire with pliers. This brittleness induced in the wire by boriding can provide easy removal, as the borided wire material is harder and is difficult to cut with ordinary tools. Optimal feed wire diameter can be determined experimentally by choosing a wire diameter that will reliably retain the parts during treatment. The conductive iron wire used for connections below the electrolyte surface below can have a thickness of 16 gauge for parts borided to a depth of 100 microns and having areas approximately 100 square inches down to very small parts. Wires smaller than 16 gauge can be used for small parts with thinner boriding.

Suitable pulse generators include pulse generators capable of producing, in combination with the power supply, the time-varying electric currents described herein, and are known to those having ordinary skill in the art. For example, suitable power supplies include BK Precision model 4052 Series Function/Arbitrary Waveform Generator, providing waveforms feeding into a BK Precision Model 1694 switching DC power supply capable of maximum 60 amperes at 15 volts. Alternatively, the above-mentioned waveform generator provides timed pulses to a mechanical relay that switches the above-mentioned power supply to the boronizing load through a circuit that includes a series resistor, for example a 0.2 ohms resistor; the resistor function is to provide an approximately constant current during the primary pulse treatment, as the internal resistance of the boriding bath changes as the treatment progresses, and the power supply noted is a constant voltage unit. The same relay is configured to switch in a secondary current provided by a power supply model HY 3003D, a, 3 ampere maximum power supply, which automatically supplies controlled constant current. For larger parts or groups of parts, a suitable power supply may be a commercial electroplating switchable power supply, Baker model Q63PSMDB capable of providing up to 3000 amperes at 15 volts max.

This disclosure provides a method of enhancing a surface of a workpiece. In certain aspects, this disclosure provides a method of boronizing a surface of a metal workpiece. The method can include one or more of the following steps: a) immersing at least a portion of the workpiece in a salt bath; b) applying a time-varying electric current between the workpiece and an anode, thereby boronizing the surface of the workpiece; and c) removing the workpiece from the salt bath.

In certain aspects, step a) can include fully immersing the workpiece in the salt bath.

In certain aspects, the methods described herein can further comprise quenching the workpiece. Quenching the workpiece can include leaving the workpiece in the salt bath for a predetermined length of time, such as a length of time between 1 minute and 100 minutes, including but not limited to, a length of time between 2 minutes and 60 minutes, between 5 minutes and 30 minutes, or between 10 minutes and 15 minutes. Quenching the workpiece can include removing the workpiece from the salt bath and placing the workpiece in a second salt bath for the predetermined length of time, or another non-salt liquid held at a temperature appropriate for heat treatment of the boronized parts. Quenching the workpiece can include removing the workpiece from the salt bath and introducing the workpiece to an inert atmosphere. Quenching the workpiece can be performed at an elevated temperature, such as a temperature between 400° C. and 1500° C., including but not limited to, a temperature between 500° C. and 1250° C., between 600° C. and 1000° C., between 700° C. and 900° C., or between 750° C. and 800° C. Quenching the workpiece can include any quenching process known to those having ordinary skill in the art.

The time-varying electric current can include a primary electric current pulse and a secondary electric current pulse. In certain aspects, the secondary electric current pulse can be viewed as a non-zero baseline current density and the primary electric current pulse can be viewed as a series of current pulses that provide a primary current density that is higher than the baseline current density. The series of pulses can have the properties described herein with respect to the primary electric current pulse. The non-zero baseline current density can have the properties described herein with respect to the secondary electric current pulse.

The time-varying train of electric current pulses can be applied for an overall duration of between 1 second and 360 minutes, including but not limited to, an overall duration of between 6 seconds and 300 minutes, between 1 minute and 120 minutes, between 2 minutes and 110 minutes, between 4 minutes and 100 minutes, between 5 minutes and 90 minutes, between 10 minutes and 75 minutes, between 15 minutes and 60 minutes, between 30 minutes and 45 minutes, between 12 minutes and 30 minutes, or between 30 seconds and 15 minutes.

The time-varying electric current can include two or more cycles of primary and secondary electric current, including but not limited to, three or more, four or more, five or more, ten or more, fifty or more, one hundred or more, or any number of cycles up to and including a number of cycles where the process incurs diminishing returns. The time-varying electric current can include a higher current for a first time period, a lower current for a second time period, a higher current for a third time period, a lower current for a fourth time period, and so on, repeating for any number of cycles up to and including a number of cycles where the process incurs diminishing returns.

In certain aspects, the time-varying electric current can include a duty cycle between the primary electric current pulse and the secondary electric current pulse, measured as the time the primary electric current pulse is active divided by the time the primary and secondary electric current pulses are active, of between 0.1% and 50%, including but not limited to, a duty cycle of between 0.2% and 40%, between 0.3% and 30%, between 0.5% and 25%, between 1% and 20%, between 2% and 15%, between 3% and 10%, between 4% and 5%, between 5% and 7.5%, between 7.5% and 12.5%, or between 10% and 17.5%.

The primary electric current pulse can provide a primary current density that initiates release of boron from the at least one source of boron. The primary electric current pulse can provide a primary current density of between 0.01 $A/cm^2$ and 10.0 $A/cm^2$, including but not limited to, a primary current density of between 0.05 $A/cm^2$ and 5.0 $A/cm^2$, between 0.1 $A/cm^2$ and 1.0 $A/cm^2$, or between 0.5 $A/cm^2$ and 0.75 $A/cm^2$.

In certain aspects, the primary current density produced by the primary electric current pulse can be substantially constant over the course of applying the time-varying electric current. In certain aspects, the primary current density produced by the primary electric current pulse can increase over the course of applying the time-varying electric current. The primary current density can be substantially constant over the course of individual primary electric current pulses. In some cases, the primary current density can increase or decrease over the course of individual primary electric current pulses. The pulse generator can be programmed to control the primary current density. It should be appreciated that the strength of the primary current density improves the "throwing power" of the process, which results in a more uniform boronization.

The primary electric current pulse can have a primary pulse duration of between 1 ms and 15 s, including but not limited to, a primary pulse duration of between 5 ms and 10 s, between 10 ms and 9 s, between 50 ms and 8 s, between 100 ms and 7.5 s, between 250 ms and 5 s, between 500 ms and 2.5 s, or between 1 s and 2 s. The primary pulse duration can be substantially constant over the course of applying the time-varying electric current. The primary pulse duration can increase or decrease over the course of applying the time-varying electric current. The pulse generator can be programmed to control the primary pulse duration.

The secondary electric current pulse can provide a secondary current density of less than 50% of the primary current density, including but not limited to, a secondary current density of less than 40% of the primary current density, less than 30% of the primary current density, less than 25% of the primary current density, less than 20% of the primary current density, less than 15% of the primary current density, less than 10% of the primary current density, less than 7.5% of the primary current density, less than 5% of the primary current density, less than 4% of the primary current density, less than 3% of the primary current density, less than 2% of the primary current density, or less than 1% of the primary current density. The secondary electric current pulse can provide a secondary current density that is at least 1 mA/square centimeter.

In certain aspects, the secondary current density produced by the secondary electric current can be substantially constant over the course of applying the time-varying electric current. In certain aspects, the secondary current density produced by the secondary electric current can increase over the course of applying the time-varying electric current. In certain aspects, the secondary current density produced by the secondary electric current pulses can decrease over the course of applying the time-varying electric current. In some cases, the secondary current density can increase or decrease over the course of individual secondary electric pulses. The pulse generator can be programmed to control the secondary current density.

In yet another aspect of the invention, the formation and growth of undesired FeB in the surface region of parts being treated is managed by employing primary or secondary pulses whose amplitude, duration, or spacing are varied during the execution of the boronization process to adjust the concentration of boron at the surface as treatment progresses. One, or a combination, of the following methods results in the desired substantial formation of the desired $Fe_2B$: 1) the length of time between primary pulses may be progressively increased during the execution of the boronization process; 2) the amplitude of the primary pulse current may be progressively reduced during the execution of the boronization process; 3) the duration of the primary pulses may be progressively reduced during the execution of the boronization process; and 4) the amplitude of the secondary pulse may be progressively reduced during the execution of the boronization process. By these methods, time is provided for small quantities of FeB to diffusion-anneal into the surface, or for excess boron to leave the surface and to re-enter the boronizing electrolyte, resulting in predominately the desired $Fe_2B$, without ever building up large amounts of FeB. If thick deposits of FeB are allowed to collect and later diffused away, as is the practice with some methods, a more porous, more internally strained, and lower performance boride layer results. The methods described in the invention prevent the formation of thick FeB deposits, yet keep the supply of boron near the surface of parts at a high value to assure rapid up-take and more economical treatment.

In certain aspects, as the boronized layer build up, the current density and duration of the pulses and/or the duration between pulses can advantageously be adjusted to prevent the formation of the monoboride FeB at the surface or to promote the formation of a controlled monoboride layer when there is a need for added surface hardness. Lowering the current density, shortening the pulse duration, and increasing the time between pulses all can reduce the rate of boron deposition and consequentially reduce or eliminate the amount of FeB in the final product.

In yet another aspect of the invention, after treating a part to contain substantially $Fe_2B$ at the surface, it is possible to readily provide a thin layer of the harder FeB by means of the controls noted in the previous paragraph. For example, by means of applying one or a small number of intense or longer primary pulses near the end of the process, it is possible to build a thin layer that, in some applications, will offer improved service qualities. This control is unavailable in previous boronization systems.

In aspects where the workpiece is a ferrous metal workpiece, the secondary electric current pulse can provide a secondary current density that is greater than the current density necessary for $Fe_2B$ to form on the surface and less than the current density above which FeB forms on the surface.

The secondary electric current pulse can have a secondary pulse duration of between 0.01 s and 250 s, including but not limited to, a secondary pulse duration of between 2 s and 200 s, between 3 s and 150 s, between 4 s and 100 s, between 5 s and 75 s, between 10 s and 60 s, between 20 s and 50 s, between 30 s and 40 s, between 45 s and 120 s, or between 60 s and 240 s. The secondary pulse duration can be substantially constant over the course of applying the time-varying electric current. The secondary pulse duration can increase or decrease over the course of applying the time-varying electric current. The pulse generator can be programmed to control the secondary pulse duration.

A person having ordinary skill in the art will recognize that the pulse duration and intensity can be varied to produce different boride layer thickness or to account for properties of the material being borided.

In certain aspects, applying the secondary electric current occurs substantially instantaneously following applying the primary electric current. In certain aspects, two or more cycles of primary and secondary electric current occur substantially instantaneously following one another. It should be appreciated that substantially instantaneously allows for small discontinuities in current that do not negatively impact the boronizing process. It should also be appreciated that a non-zero baseline current allows for small discontinuities in current that do not negatively impact the boronizing process.

The time-varying electric current can be terminated before or after removing the workpiece from the salt bath.

Typically, when boronizing with a large number of parts, the electric connections need to be carefully engineered to deal with thousands of amperes that need to be imparted on the samples, with the connections housed in an intermediate temperature region above the salt bath that itself can reach temperatures of upwards of 1100° C. Due to the nature of the time-varying electric current described herein, the electrochemical system can utilize connections that would otherwise be unsuitable for use in a process that maintains a continuous higher current. In certain aspects, the electric connections can be individual resistors connected to the power supply and pulse generator at one end and to an individual workpiece or rack of workpieces at the other end. The secondary electric current pulse or non-zero current density power supply can be voltage stabilized or current stabilized, and owing to the effect of the in-series resistors, thereby providing an essentially constant current during the second electric current pulse or the non-zero baseline current density. The primary electric current pulse or series of primary electric current pulses can be applied sequentially to individual workpieces from among a group of workpieces and/or directly to the part side of the individual resistors. If a plurality of workpieces are being treated, the resistors can be specified to provide consistent currents, as calculated using Ohm's law.

In certain aspects, separate power supplies can be connected and disconnected from treated parts through single pole double throw relays or equivalent switching circuits. Current delivery can be designed by those having ordinary skill in the art to supply the required currents, irrespective of varying resistance in connections between parts and electric feed wires, and changes in the boronizing cell voltage as boronization progresses during individual primary and secondary pulses, and over the interval of many pulses. Here the cell voltage is taken to be the potential between anode and cathode measured in the fluid or near to the fluid surface.

A convenient method to measure the cell voltage is to connect wires to the part under treatment and to the anode at a point below the fluid and place alumina ceramic tubes over the wire leads to prevent erosion of the wires and to shield against signal pick-up by the wires directly from the electrolyte. The voltages can be conveniently recorded on an oscilloscope having the ability to record data, for example the BK precision model 2532B Storage Oscilloscope.

In certain aspects, the methods can further include agitating the salt bath. In some aspects, agitating the salt bath can be performed by mechanical stirring of the salt bath, vibration of the workpiece, by magneto-hydrodynamic forces generated in the salt bath by the time-varying electric current, or by other techniques known to those having ordinary skill in the art. Because the magneto-hydrodynamic forces generated in fluids are proportional to the square of the applied current, the intense pulses of the time-varying electric current described herein can enhance the agitation of the salt bath.

In certain aspects, the salt bath can comprise a primary component a material selected from the group consisting of borax ($Na_2B_4O_7$), boric acid ($H_3BO_3$), NaCl, $CaCl_2$, $Na_2CO_3$, KCl, alkali metal fluoroborates, where the alkali component is most commonly Na, K, Li, but Cs and Rb may also be used. Boron carbide, and finely powdered ferro-boron or boron can be advantageous additions, as well as alkaline earth chlorides such as $CaCl_2$ or the chlorides of barium or magnesium may also be added, as well as ammonium chloride, and combinations thereof.

In certain aspects, the salt bath can include the main component in an amount of between 5 wt % and 100 wt %, including but not limited to, an amount of between 10 wt % and 95 wt %, between 15 wt % and 90 wt %, between 25 wt % and 85 wt %, between 50 wt % and 80 wt %, between 55 wt % and 75 wt %, or between 60 wt % and 70 wt %.

In certain aspects, the source of boron can be selected from the group consisting of borax, boric acid, and alkali fluoroborates, as well as boron carbide, pure boron, such as pure boron chunks or pure boron powder, ferro-boron, such as ferro-boron powder or ferro-boron chunks, and combinations thereof.

In certain aspects, the salt bath can include the source of boron in an amount of between 1 wt % and 100 wt %, including but not limited to, an amount of between 5 wt % and 75 wt %, between 7.5 wt % and 50 wt %, between 10 wt % and 25 wt %, or between 15 wt % and 20 wt %.

In certain aspects, the salt bath can be maintained at a temperature between 500° C. and 1500° C., including but not limited to, a temperature between 600° C. and 1400° C., between 700° C. and 1300° C., between 750° C. and 1200° C., between 800° C., and 1100° C., between 850° C. and 1000° C., or between 950° C. and 1000° C.

In certain aspects, the salt bath can be phase separated into a first phase that is primarily the source of boron and a second phase that is primarily the main component. For example, the salt bath can include borax as the source of boron and NaCl as the main component, and the first phase can be borax with a small amount of NaCl dissolved therein and the second phase can be NaCl with a small amount of borax dissolved therein. With a phase separated salt bath, the workpiece can be immersed in the second phase, and the amount of borax dissolved in the second phase can be sufficient for the boronizing process. Alternately, the workpiece can span the two phases, and different boronizing results can be achieved the portions of the workpiece located in the different phases.

In certain aspects, the salt bath can consist essentially of NaCl and borax. The salt can consist essentially of 70-90 wt % NaCl and 10-30 wt % borax, such as 80 wt % NaCl and 20 wt % borax. It should be appreciated that this salt bath is convenient, low cost, and can be disposed of relatively easily without toxic byproducts.

In certain aspects, the main component and the source of boron can be the same.

In certain aspects, the workpiece can comprise a metal, in which case, the workpiece can be described as a metal workpiece. In certain aspects, the metal workpiece can comprise a metal selected from the group consisting of iron, titanium, aluminum, cobalt, chromium, hafnium, molybdenum, nickel, niobium, tantalum, tungsten, vanadium, zirconium copper, manganese, technetium, ruthenium, rhenium, palladium, silver, rhodium, osmium, iridium, platinum, gold, carbon, alloys thereof, and combinations thereof. In certain aspects, the metal workpiece can comprise iron and alloys thereof In certain aspects, the metal workpiece can comprise steel.

In certain aspects, the workpiece can comprise a non-metal, in which case, the workpiece can be described as a non-metal workpiece. In certain aspects, the non-metal workpiece is utilized in place of the metal workpiece described herein. In aspects utilizing a non-metal workpiece, the non-metal workpiece can be made of a material having at least one component that can react with boron. For example, boriding can enhance the performance of composites, consisting of hard particles bound together and anchored to a substrate with other softer materials known as binders or matrix. Composites are applied to substrates by many thermal processes, as well as by cold spray and by brazing composite preforms to substrates. Boronization can enhance the hardness and corrosion properties of the matrix binder, as well as the hard materials in some cases. Some examples of hard material in such composites include tungsten carbide, titanium diboride, chromium carbide, boron carbide, diamond, silicon carbide, silicon oxycarbide, and other similarly hard materials. This list may be expanded with many other materials, Commonly used binders include nickel or cobalt, often with small percentages of other metals, but many other matrix compositions may be used. The nickel and cobalt and alloys thereof, as well as many other matrix materials can form very hard borides during boriding, either after or before the composite is applied to the substrate. Composite preforms may be borided as a final step in production of the preform, or after the preform is affixed to the substrate. Cast iron, which contains particles composed of carbon may also be borided; the carbon generally remains as the iron boride forms around the particles. Any material that is electrically conductive at the temperature in a molten salt bath and having the other features described herein can be suitably borided by the methods described herein.

In certain aspects, the workpiece can comprise metal and non-metal, such as at least one metal material and at least one non-metal material selected from the materials described herein.

In certain aspects, the methods described herein can improve one or more properties of the workpiece. The one or more properties can relate to the material as a whole or to the surface of the material. In an aspect, the one or more properties can relate to the surface of the material. The one or more properties include, but are not limited to, hardness, scuff resistance, corrosion resistance, neutron absorption, friction, radiation emissivity, appearance, conductivity, and other physical and mechanical properties.

In certain aspects, the methods described herein can provide a superconducting material, for example, by choosing salts with low melting point and electrodepositing boron on to magnesium.

This disclosure describes the systems and methods in terms of a boronizing process, but the principles described herein can be used for other materials in addition to boron or in place of boron. For example, suitable replacements for boron include, but are not limited to, carbon, nitrogen, sulfur, and phosphorous, and silicon. These elements may be released on surfaces of appropriately biased electrodes from molten salts, and can find application in surface modification.

This disclosure describes systems and methods that utilize a salt bath, but can suitably be deployed with a different medium as the working fluid. For example, suitable replacements for the salt bath include, but are not limited to, strongly heated plasma arc vapors within aqueous solutions, and the like. The replacement for the salt bath should have at least some capacity to conduct electricity.

In one aspect of this disclosure where carbon deposition is being performed, the salt bath described herein can comprise sodium carbonate and sodium chloride.

EXAMPLE 1

Using a graphite or silicon carbide crucible gave similar results on experiments reported here. A salt mix containing a 50 weight % each of borax and sodium chloride was used to test samples of 10B38 low carbon steel suspended on a ¼ inch iron support two inches from a 1 inch diameter graphite rod extending through the fluid surface and submerged several inches into the fluid. Heat was provided by immersing the crucible in a furnace containing a 50-50 mix of sodium chloride and potassium chloride on the outer surface of graphite crucible, with temperature, current density and salt concentrations inside the crucible as specified for some examples that follow. A Leco glow discharge spectrometer was used to measure the amount of boron deposited in the sample. The sodium chloride salt did not mix thoroughly, and maintained a phase separation that was made visible by some unknown-composition particles, possibly elemental boron or carbon, observed to float at the interface of fluids. A blemish on the sample was observed corresponding to the observed phase separation. On later experiments, the borax content was reduced to 20 weight percent, and the samples kept from the lower region of the crucible, giving homogeneous boriding.

A sample of 10B38 steel was tested at 5 minute processing time using current density as a variable 50, 100, 200, 400, 800 milliamps per square centimeter. A temperature of 1570° F. was maintained in the crucible, and the sample was immediately water quenched after treatment. For current density below 200 milliamps per square centimeter, there was only slight boronization, and above 200 milliamperes, the sample surface contained about 10 Wt. % peak boron trailing off to near zero at 10 microns depth. At least for short processing time, there is thus a threshold for the start of boronization in the vicinity of 0.1 to 0.2 amps per square centimeter.

In another test, a 78 minute run at temperature 1965° F. using primary pulses of five seconds each, spaced at 55 seconds from end of one pulse to start of next pulse, using current density approximately 0.5 amperes per square centimeter, and maintaining a current density of between 3 and 4 percent of the primary pulse current density, a peak boron level of 19 weight % was observed, with a depth trailing off to low values after 100 microns. Broadly similar results were obtain using 2 second primary pulses and a 12 second period. Removing the secondary current in subsequent tests greatly diminishes the boron uptake in the sample, with peak boron levels falling as low as 0.1 weight percent, establishing the value of using a secondary current much smaller than the current needed to electrolyze the fluid and to boronize. Surprisingly, the two currents were complementary, with the effect of boronization being much more effective when primary and secondary pulsed were used together.

Tests to determine the phase separation were carried out by conducting a series boronization experiments of five minutes at 0.3 Amperes per square centimeter on 10B38 steel samples, with borax concentration as the variable. Temperature was held at 1650° F. Boronization was compared in the region above the borax, which tends to stay largely below the sodium chloride. Boron concentrations were varied from 5% to 50% by weight. The amplitude and depth of boronization—about 10 weight percent and depth approximately 16 microns—were only slightly affected as concentration changed, until higher concentrations of about 37% were tested and that change may be related to the different conductivities of the two salts and the resulting changes in current distribution on the test samples. The portions of the samples extending into the lower-borax-rich region tended to gain more boron and greater penetration.

Under identical conditions of treatment, the boronization depth increased approximately as the square root of time. A 108 degree increase in temperature from 1652° F. to 1760° F. gave a change in diffusion constant of about 300%. These values are within expectations found in literature on boronization.

An example of a boronized coating likely to find use on many blade surfaces, not too thick to cause undue brittleness, and containing only the more durable di-iron boride, was produced with the following parameters. One hour treatment with 0.5 s primary pulses of current density approximately 0.5 amperes per square centimeter, and period of 30 seconds, at temperature 1770° F. The secondary current density was 2.5% of the primary current density. The boronized profile peaked at 8.5%, staying above 6% for a depth of 30 microns, and falling to about 1 Wt % at 50 microns. This treatment did not receive any diffusion time, and the surface is expected to be of excellent quality. A calculation of the Faraday efficiency of this test indicated a value in the vicinity of 100%, based upon the boron production requiring three electrons per boron atom released.

The invention has been described in connection with what are presently considered to be the most practical and preferred embodiments. However, the present invention has been presented by way of illustration and is not intended to be limited to the disclosed embodiments. Specifically, the above specific methods used are exemplary of the inventive concept and may be altered while still falling within the scope and spirit of the invention. Accordingly, those skilled in the art will realize that the invention is intended to encompass all modifications and alternative arrangements within the spirit and scope of the invention as set forth in the appended claims.

I claim:

1. A method of boronizing a surface of a metal workpiece using an electrochemical system, the electrochemical system comprising a furnace including a salt bath and an electrochemical circuit including a power supply, a pulse generator, a cathodic contact electrically coupled to the metal workpiece, and an anode, the anode positioned in the salt bath, the method comprising:

a) immersing at least a portion of the metal workpiece in the salt bath, thereby positioning the metal workpiece at a distance of between 0.1 mm and 10 cm from the anode, the salt bath comprising at least one source of boron, the salt bath having a temperature between 500 ° C. and 1500 ° C.;

b) subsequent to step a) and using the power supply and the pulse generator, applying a time-varying electric current between the metal workpiece and the anode for an overall duration of between 1 second and 180 minutes, thereby boronizing the surface of the metal workpiece, the time-varying electric current comprising primary electric current pulses and secondary electric current pulses, the primary electric current pulses providing a primary current density that initiates release of boron from the at least one source of boron, the primary electric current pulses having a primary pulse duration of between 1 ms and 15 s, the secondary electric current pulses providing a secondary current density that is less than 50% of the primary current density, the secondary electric current pulses having a secondary pulse duration of between 0.01 s and 250 s; and c) removing the metal workpiece from the salt bath.

2. The method of claim 1, wherein the primary current density increases as step b) progresses.

3. The method of claim 1, wherein the primary current density is between 0.01 $A/cm^2$ and 10.0 $A/cm^2$.

4. The method of claim 1, wherein the secondary current density is less than 20% of the primary current density.

5. The method of claim 1, wherein the secondary current density is less than 5% of the primary current density.

6. The method of claim 1, wherein the time-varying electric current is terminated prior to step c).

7. The method of claim 1, wherein the metal workpiece is composed of a material selected from the group consisting of iron, steel, titanium, aluminum, cobalt, chromium, hafnium, molybdenum, nickel, niobium, tantalum, tungsten, vanadium, zirconium, copper, manganese, technetium, ruthenium, rhenium, palladium, silver, rhodium, osmium, iridium, platinum, gold, alloys thereof, and combinations thereof.

8. The method of claim 1, wherein the primary electric current pulses are substantially identical.

9. The method of claim 1, wherein a product of the primary current density times the primary pulse duration decreases as step b) progresses or an interval between the primary electric current pulses increases as step b) progresses, thereby causing an average rate of coulombs delivered to decrease as step b) progresses.

10. The method of claim 1, wherein the primary current density, the primary pulse duration, a primary pulse repetition of the primary electric current pulses, the secondary current density, or a combination thereof are controlled to produce a predetermined relative concentration of borides on the surface of the metal workpiece.

11. The method of claim 1, wherein the metal workpiece is composed of steel.

12. The method of claim 1, wherein the metal workpiece is coupled to the cathodic contact by a conductive wire.

13. The method of claim 1, wherein the metal workpiece is a steel workpiece, the secondary electric current pulse providing the secondary current density that is greater than a first threshold above which $Fe_2B$ forms on the surface and less than a second threshold above which FeB forms on the surface.

14. The method of claim 1, wherein the salt bath comprises the source of boron in an amount between 1 wt % and 100 wt %.

15. The method of claim 1, wherein the salt bath comprises a primary component in an amount between 50 wt % and 100 wt %.

16. The method of claim 1, wherein the source of boron is selected from the group consisting of borax, potassium tetraborate, boric acid, alkali fluoroborates, boron carbide, pure boron, ferro-boron, and combinations thereof.

17. The method of claim 15, wherein the primary component is selected from the group consisting of borax, boric acid, NaCl, $CaCl_2$, $Na_2CO_3$, KCl, alkali metal fluoroborates, and combinations thereof.

18. The method of claim 1, wherein the salt bath consists essentially of 70-90 wt % NaCl and 10-30 wt % borax.

19. A method of boronizing a surface of a metal workpiece using an electrochemical system, the electrochemical system comprising an electrochemical circuit including a power supply, a pulse generator, a cathodic contact, and an anode, the method comprising:

a) positioning the surface of the metal workpiece and the anode on opposite sides of a molten salt composition at a distance of between 0.1 mm and 10 cm from one another, the molten salt composition comprising at least one source of boron, the molten salt composition having a temperature of between 500 ° C. and 1500 ° C.;

b) subsequent to step b) and using the power supply and the pulse generator, applying a time-varying electric current between the metal workpiece and the anode for an overall duration of between 1 second and 180 minutes, thereby boronizing the surface of the metal workpiece, the time-varying electric current comprising primary electric current pulses and secondary electric current pulses, the primary electric current pulses providing a primary current density that initiates release of boron from the at least one source of boron, the primary electric current pulses having a primary pulse duration of between 1 ms and 15 s, the secondary electric current pulses providing a secondary current density that is less than 50% of the primary current density, the secondary electric current pulses having a secondary pulse duration of between 0.01 s and 250 s; and c) removing the metal workpiece from contact with the molten salt composition.

20. The method of claim 19, wherein the time-varying electric current is terminated prior to step c).

* * * * *